US007239281B2

(12) United States Patent
Lu

(10) Patent No.: US 7,239,281 B2
(45) Date of Patent: Jul. 3, 2007

(54) FIN-SHAPED ANTENNA APPARATUS FOR VEHICLE RADIO APPLICATION

(75) Inventor: Yu-Sheng Lu, Pingjen (TW)

(73) Assignees: Yeoujyi Electronics Co., Ltd., Taoyuan (TW); Sky Year Investments Limited, Apia (WS)

( * ) Notice: Subject to any disclaimer, the term of this patent is extended or adjusted under 35 U.S.C. 154(b) by 0 days.

(21) Appl. No.: 11/099,509

(22) Filed: Apr. 6, 2005

(65) Prior Publication Data

US 2006/0227057 A1 Oct. 12, 2006

(51) Int. Cl.
*H01Q 1/32* (2006.01)

(52) U.S. Cl. ..... 343/713; 343/711; 343/712

(58) Field of Classification Search ..... 343/711–713, 343/718, 872, 705, 708
See application file for complete search history.

(56) References Cited

U.S. PATENT DOCUMENTS 3,939,423 A * 2/1976 Zakharov et al. ..... 343/712
4,001,696 A * 1/1977 Bannerman ..... 343/713
6,078,294 A * 6/2000 Mitarai ..... 343/713
6,380,902 B2 * 4/2002 Duroux ..... 343/713
6,525,693 B2 * 2/2003 Ugge' ..... 343/713
6,697,024 B2 * 2/2004 Fuerst et al. ..... 343/711
6,879,294 B2 * 4/2005 Yuanzhu ..... 343/713
2006/0038726 A1 * 2/2006 Iacovella et al. ..... 343/713

* cited by examiner

*Primary Examiner*—Tuyet Vo
*Assistant Examiner*—Ephrem Alemu
(74) *Attorney, Agent, or Firm*—Rosenberg, Klein & Lee

(57) ABSTRACT

A fin-shaped antenna apparatus for vehicle ratio application is electrically connected to a wireless receiver circuit and receives a radio signal. The fin-shaped antenna apparatus includes a fin-shaped cover, an AM antenna, a signal amplifier circuit board, an FM resonance circuit on the signal amplifier circuit board and a metal base. The AM antenna is separated with the FM resonance circuit. The FM resonance circuit comprises a plurality of inductors to form a resonance circuit and is connected to a metal base for enhancing the signal reception thereof. Therefore the signal quality for vehicle ratio application is enhanced.

7 Claims, 7 Drawing Sheets

Antenna Gain(V)(dBi)

Antenna Gain(H)(dBi)

FIN-SHAPED ANTENNA APPARATUS FOR VEHICLE RADIO APPLICATION

BACKGROUND OF THE INVENTION

1. Field of the Invention

The present invention relates to a fin-shaped antenna apparatus for vehicle radio application, and more particularly to fin-shaped antenna apparatus with enhanced AM/FM radio reception and arranged on vehicle top casing.

2. Description of the Prior Art

The rapid progress of wireless technology provides more portability to electronic products. More particularly, the wireless electronic products generally comprise antenna designed for particular frequency, directive and radio strength. The conventional antenna is made into rod shape with length corresponding to the quarter wavelength of the radio wave used. Taking the antenna used for vehicle radio as example, the vehicle antenna is a telescopic rod for both AM and FM reception. However, the vehicle antenna might have the problem of retraction after long time use, which is troublesome for user.

To solve this problem, a helix antenna made of spiral metal wire is developed. However, the reception quality of the helix antenna is not satisfactory. Moreover, a glass antenna is developed wherein flexible conductive material is coated on vehicle glass to function as AM-FM dual antenna. However, the flexible conductive material is expensive. Moreover, a printed circuit board with special-shaped planar antenna is also developed. However, the signal reception quality is poor when the planar antenna is assembled to metal vehicle casing due to the signal absorption by metal casing.

SUMMARY OF THE INVENTION

The present invention provides a fin-shaped antenna apparatus for vehicle radio application, which can be assembled atop the vehicle for aesthetic effect and can enhance AM/FM radio reception quality.

Accordingly, the fin-shaped antenna apparatus for vehicle ratio application is electrically connected to a wireless receiver circuit and receives a radio signal. The fin-shaped antenna apparatus includes an AM antenna comprising magnetic core with winding thereon, a signal amplifier circuit board, an FM resonance circuit on the signal amplifier circuit board. The AM antenna is separated with the FM resonance circuit. The FM resonance circuit comprises a plurality of inductors to form a resonance circuit, which is connected to a metal base for enhancing the reception thereof. Therefore, the signal quality for vehicle radio application is enhanced.

The above summaries are intended to illustrate exemplary embodiments of the invention, which will be best understood in conjunction with the detailed description to follow, and are not intended to limit the scope of the appended claims.

BRIEF DESCRIPTION OF THE DRAWINGS

The features of the invention believed to be novel are set forth with particularity in the appended claims. The invention itself however may be best understood by reference to the following detailed description of the invention, which describes certain exemplary embodiments of the invention, taken in conjunction with the accompanying drawings in which:

DETAILED DESCRIPTION OF THE INVENTION

Figure 1:
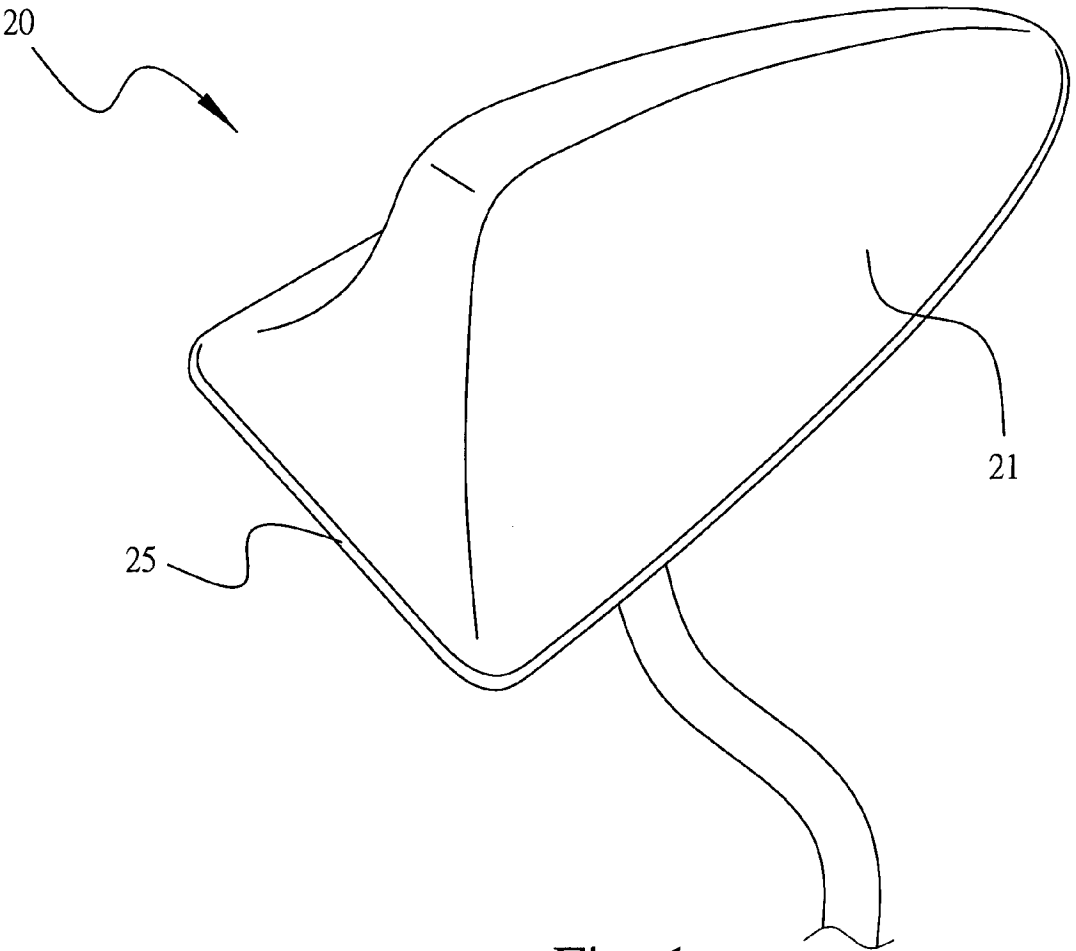
FIG. 1 shows a perspective view of the fin-shaped antenna for vehicle radio according to the present invention.
Figure 2:
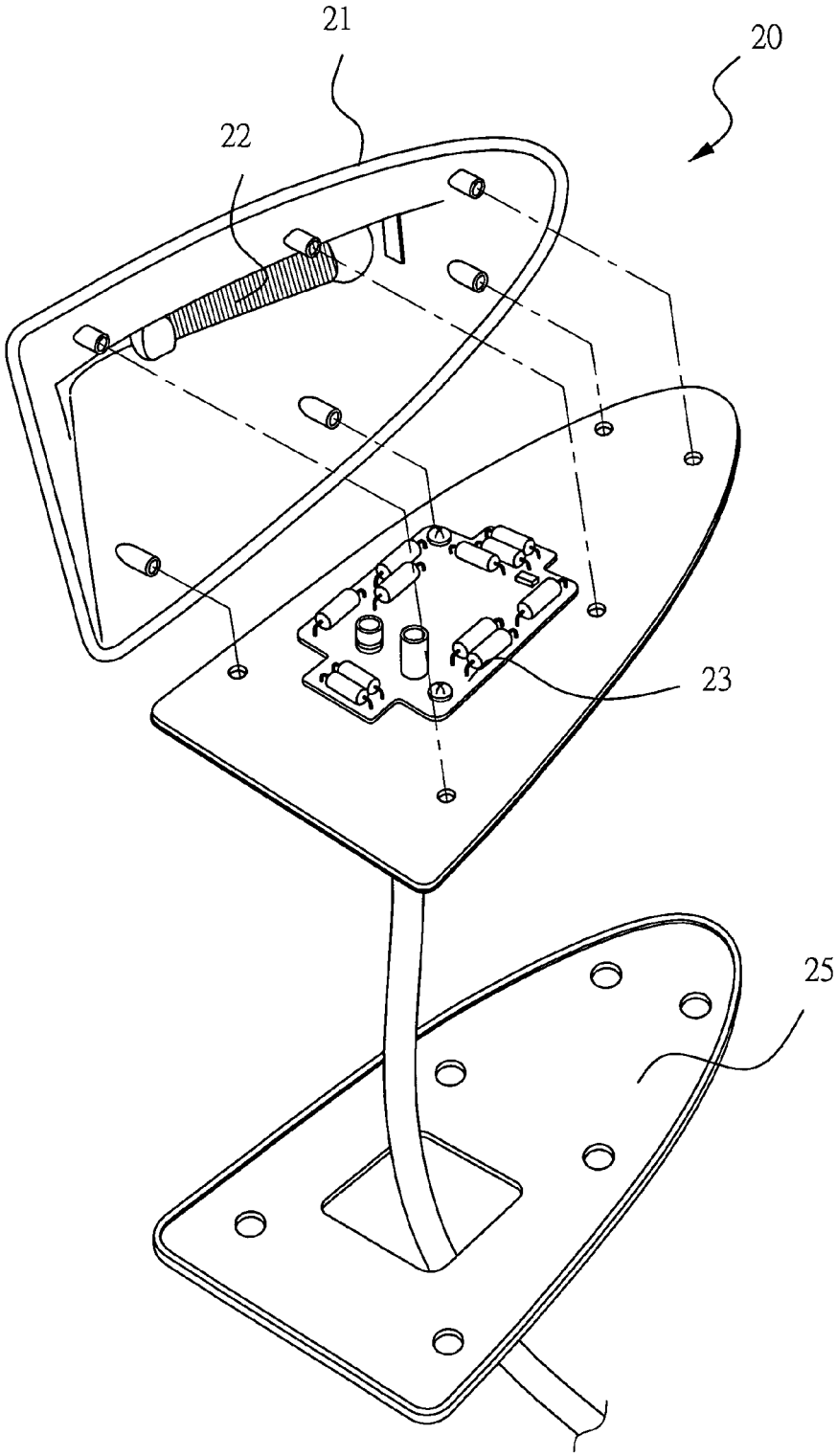
FIG. 2 is an exploded view of the fin-shaped antenna for vehicle radio according to the present invention.

FIG. 1 shows a perspective view of the fin-shaped antenna for vehicle radio according to the present invention. FIG. 2 is an exploded view of the fin-shaped antenna for vehicle radio according to the present invention. The fin-shaped antenna is used to receive broadcast signal of radio station before the processing of a wireless receiver circuit of the vehicle radio. As shown in FIG. 1, the fin-shaped antenna has shape like fish fin and can be arranged on vehicle casing. The fin-shaped antenna has aesthetic shape with better signal reception than conventional telescopic antenna or glass antenna.

As shown in FIG. 2, the fin-shaped antenna apparatus 20 according to the present invention comprises a fin-shaped cover 21, an AM antenna 22 with magnetic core and winding, a signal amplifier circuit board 23, an FM resonance circuit 24 on the signal amplifier circuit board 23 and a metal base 25.

Figure 3:
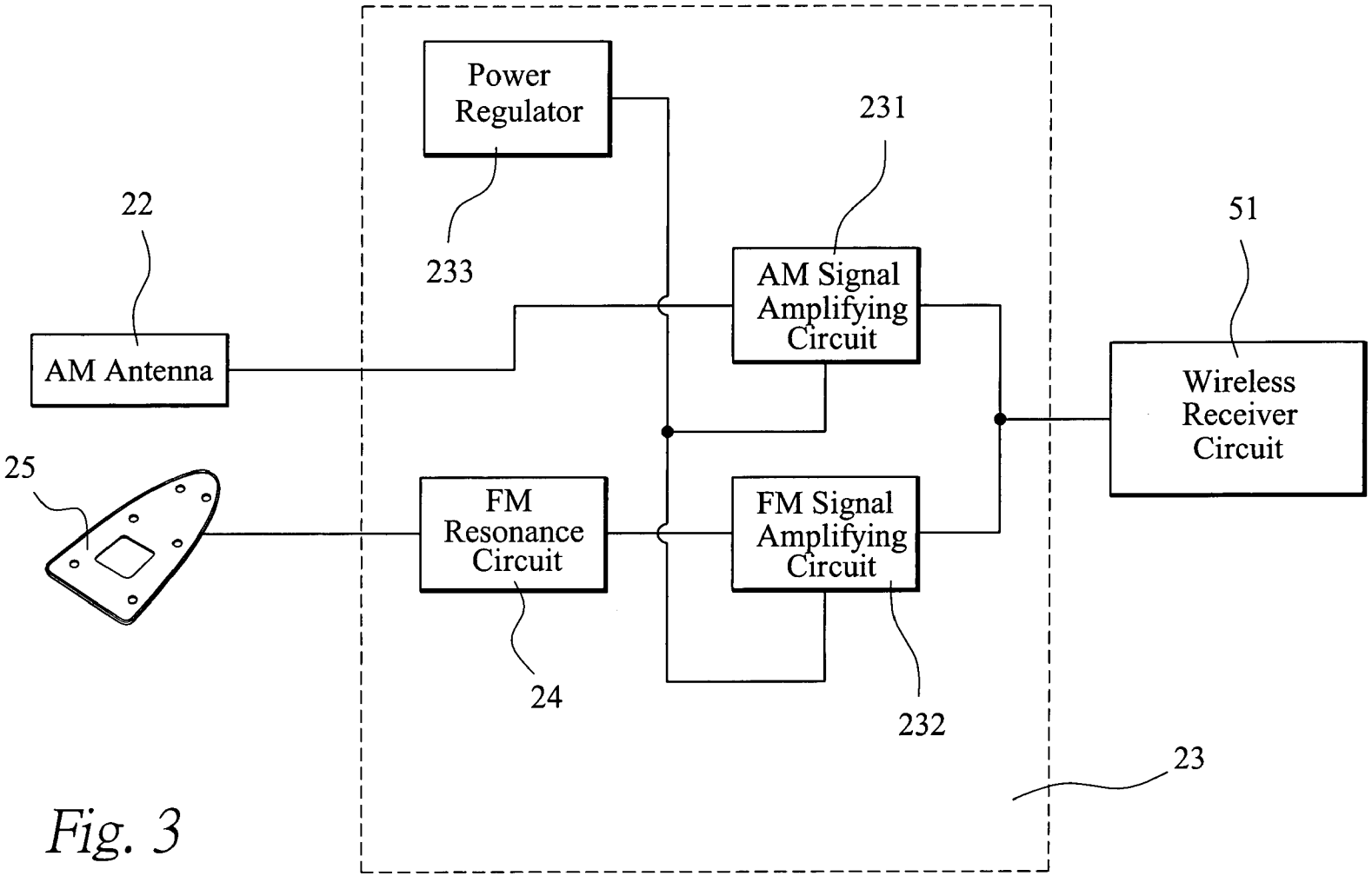
FIG. 3 shows the block diagram of the present invention.
Figure 4:
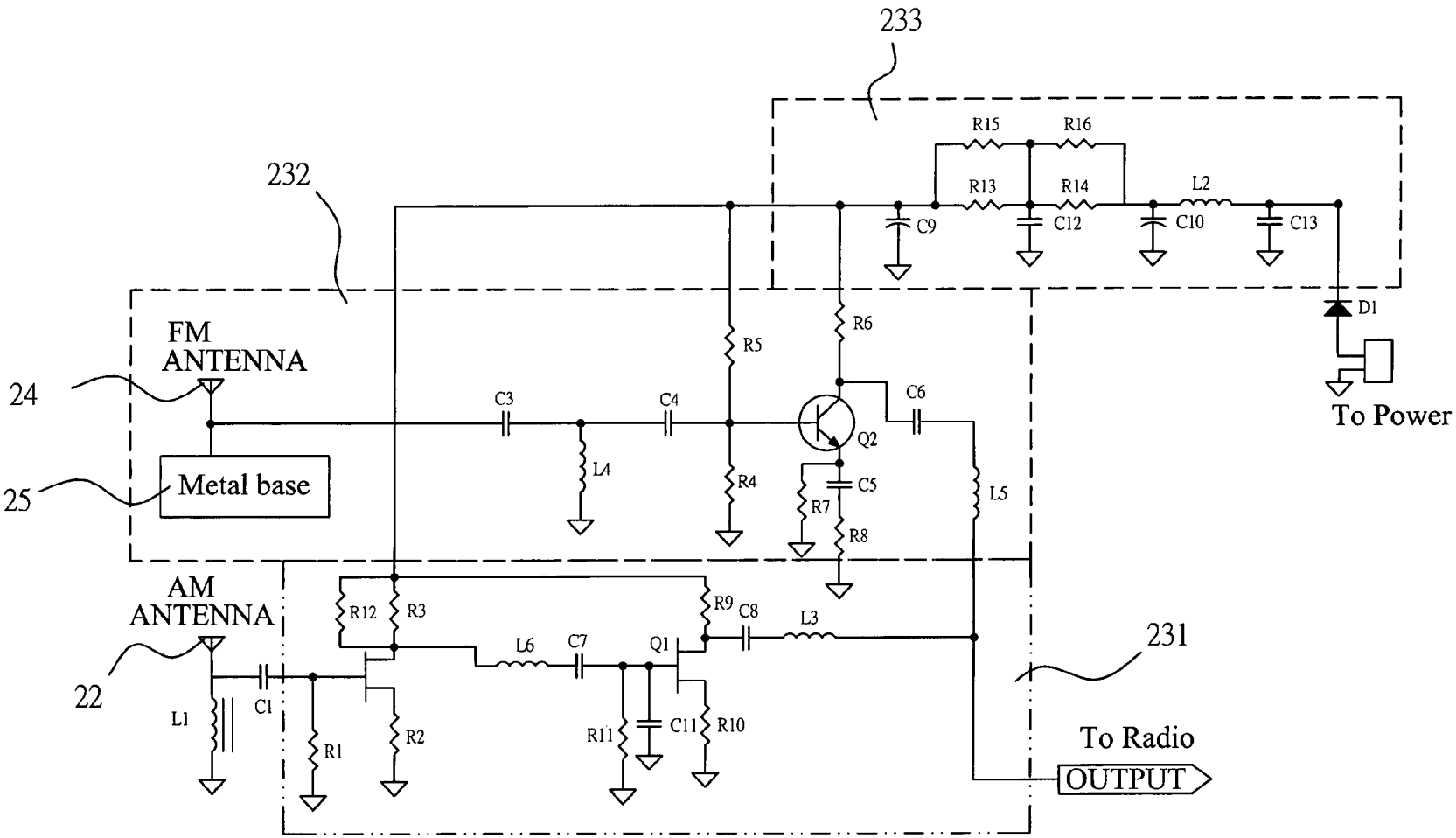
FIG. 4 shows the circuit diagram of the present invention.

FIGS. 3 and 4 show the block diagram and circuit diagram of the present invention. As shown in FIG. 3, the fin-shaped antenna 20 is connected to an antenna signal input of a wireless receiver circuit 51. The AM antenna 22 is arranged on inner side of the fin-shaped cover 21 and arranged on topside of the fin-shaped inner space of the fin-shaped antenna 20.

The signal amplifier circuit board 23 is arranged atop the metal base 25 and comprises an AM signal amplifying circuit 231 for the AM antenna 22, an FM signal amplifying circuit 232, and a power regulator 233. The signal amplifier circuit board 23 is mounted with the FM resonance circuit 24 thereon. In the present invention, the FM resonance circuit 24 is composed of a plurality of inductors to form FM resonance circuit with the FM signal amplifying circuit 232. The FM resonance circuit 24 provides impedance match with the wireless receiver circuit 51 in the radio band of interest. Therefore, the present invention has better FM reception than conventional FM receiver circuit.

As shown in FIG. 4, the AM antenna is separated with the FM antenna in the present invention; different from a sharing AM-FM antenna in prior art vehicle radio. The AM antenna 22 is an unbalanced circuit and the FM antenna 24 is a balanced circuit. The power regulator 233 is powered by a vehicle power and provides a stable electrical power to the AM signal amplifying circuit 231 and the FM signal amplifying circuit 232.

With reference back to FIG. 2 again, the metal base 25 on bottom of the fin-shaped antenna apparatus 20 not only fixes the fin-shaped antenna apparatus 20 to vehicle top casing, but also enhances the signal reception for FM antenna when the metal base 25 is connected to the FM antenna. Moreover, the fin-shaped antenna apparatus 20 has excellent impedance match with the wireless receiver circuit 51. In the shown preferred embodiment of the present invention, the impedance is about 50 Ohm.

The fin-shaped antenna apparatus 20 according to the present invention has compact size and is suitable for arranging on vehicle top casing. The fin-shaped cover 21 encloses the AM antenna 22 and the signal amplifier circuit board 23. Therefore, the fin-shaped cover 21 provides protection for circuit inside and aesthetic effect for overall appearance.

Figure 5:
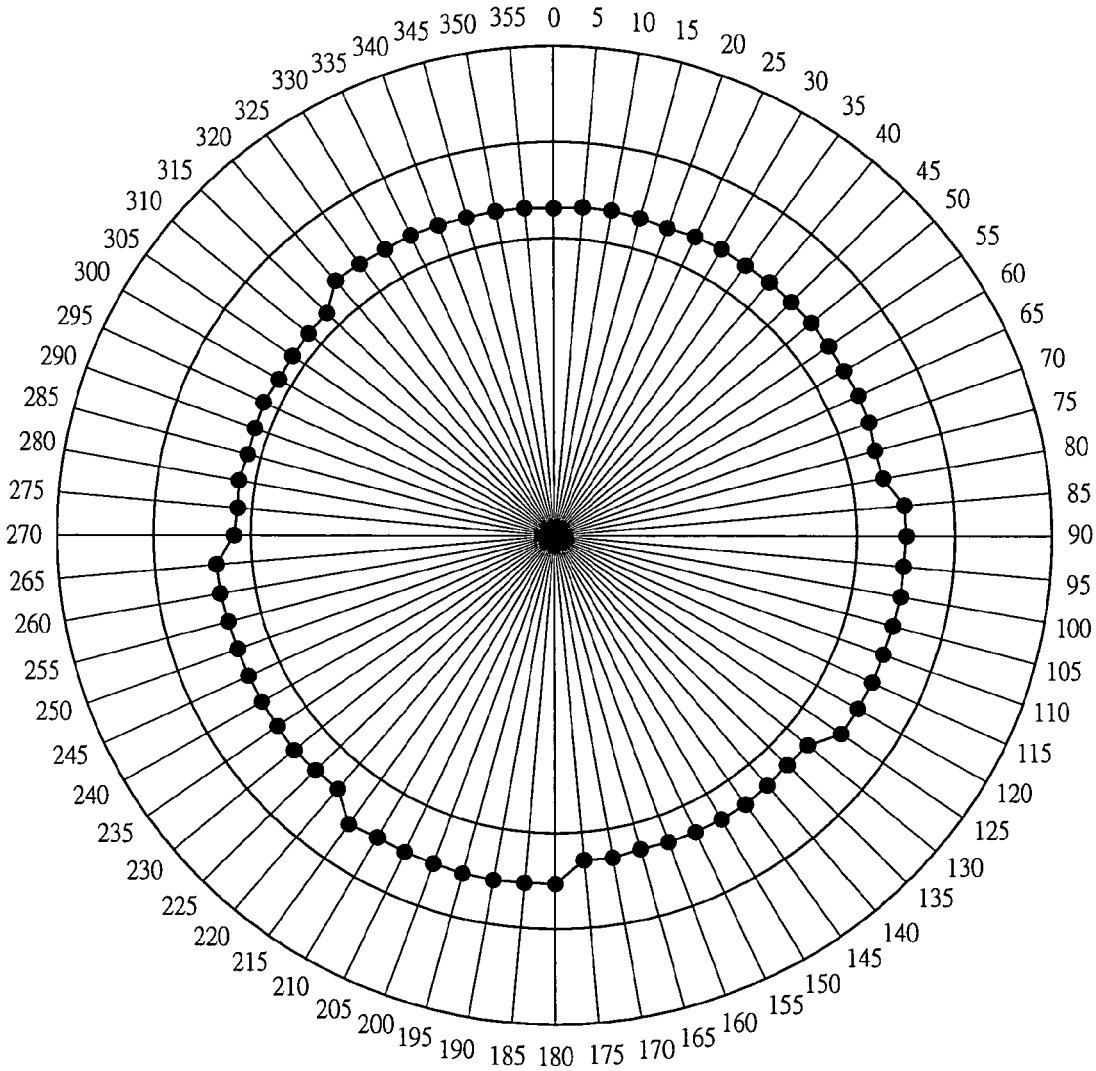
FIG. 5 shows the radiation characteristic of antenna gain for the fin-shaped antenna apparatus in vertical plane.
Figure 6:
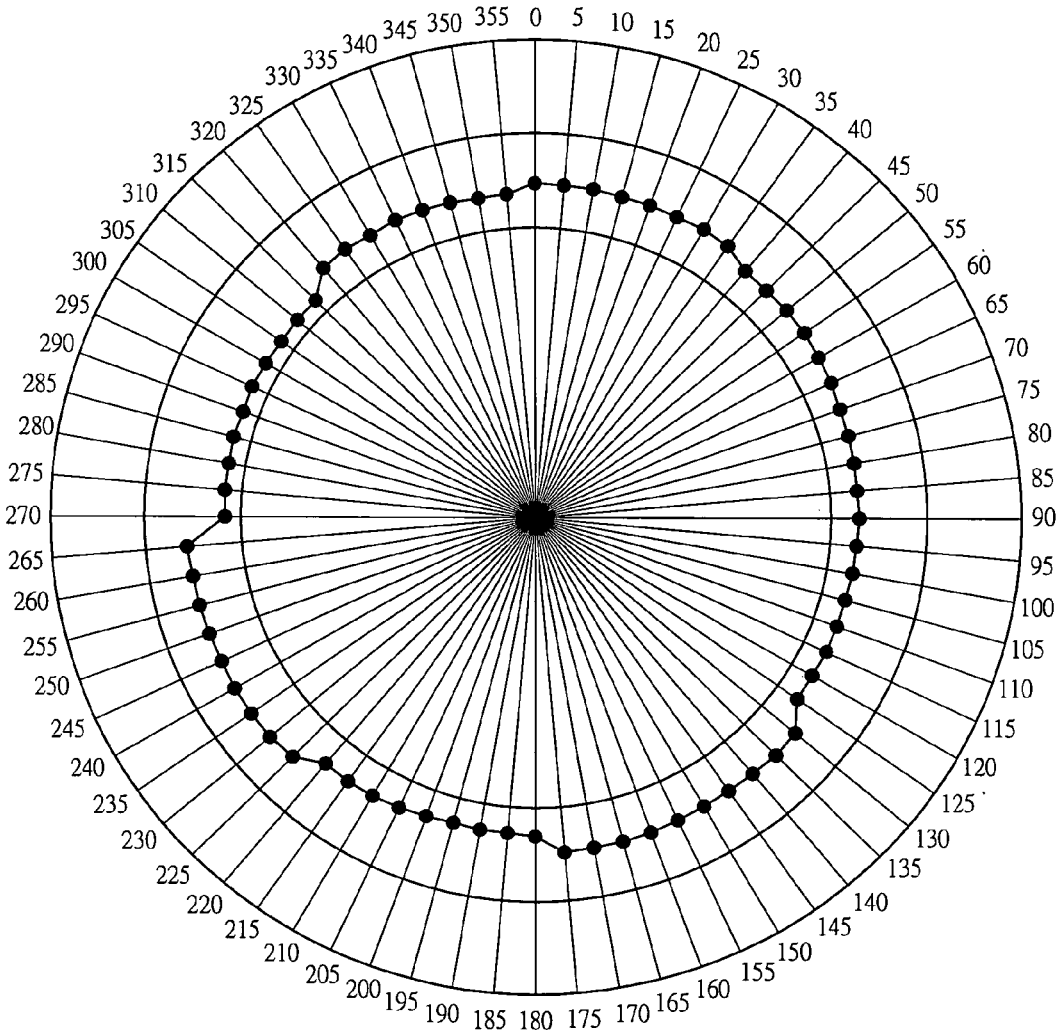
FIG. 6 shows the radiation characteristic of antenna gain for the fin-shaped antenna apparatus in horizontal plane.

FIG. 5 shows the radiation characteristic of antenna gain for the fin-shaped antenna apparatus 20 according to the present invention in vertical plane. FIG. 6 shows the radiation characteristic of antenna gain for the fin-shaped antenna apparatus 20 according to the present invention in horizontal plane. As can be seen from those figures, the antenna gain for the fin-shaped antenna apparatus 20 according to the present is about 0–3 dBi.

Figure 7:
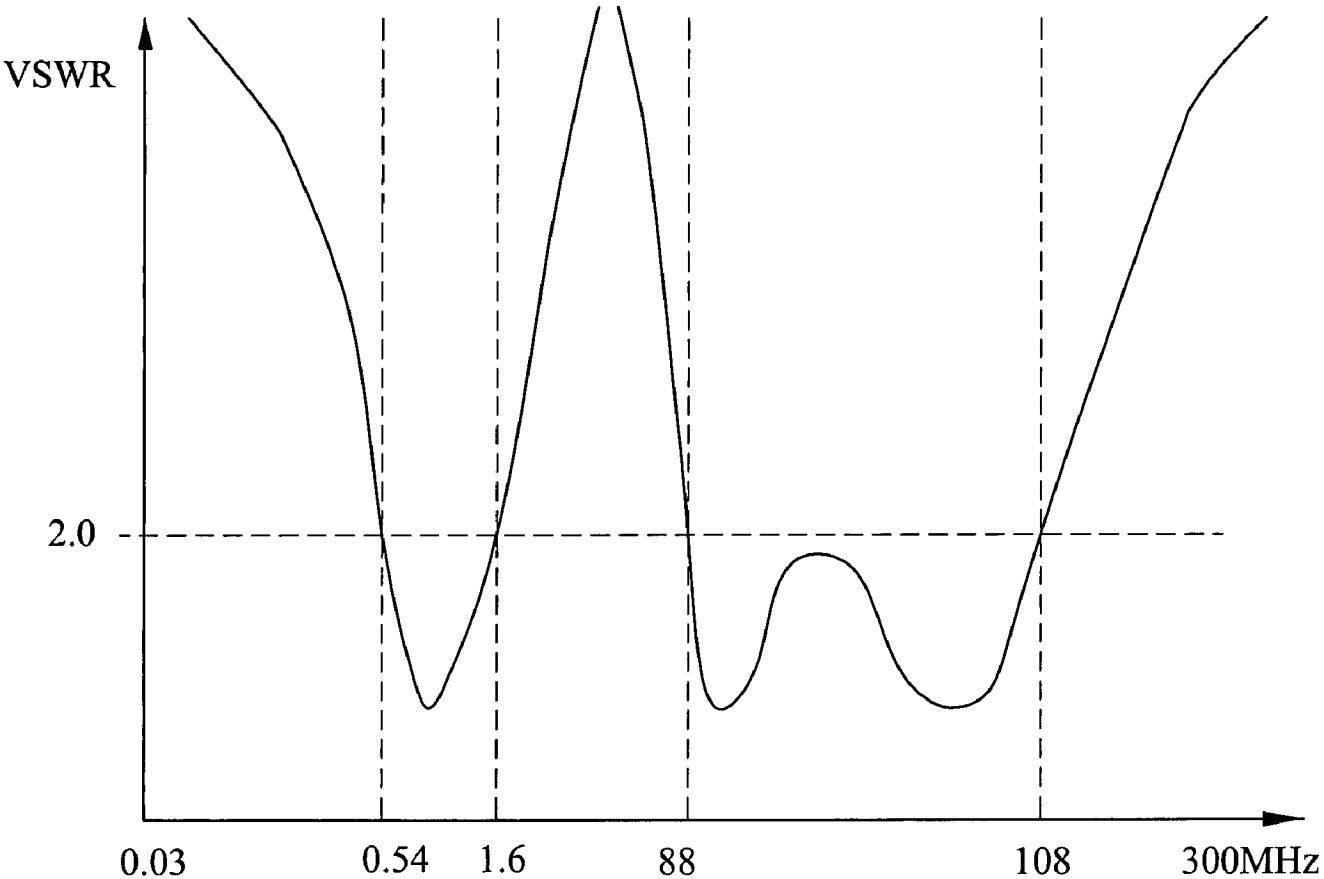
FIG. 7 shows the frequency response for the fin-shaped antenna apparatus according to the present invention.

FIG. 7 shows the frequency response for the fin-shaped antenna apparatus 20 according to the present invention, wherein the frequency range is between 30 KHz to 300 MHz. The fin-shaped antenna apparatus 20 has SWR (standing wave ratio)<=2 for the frequency band 540K~1600 KHz (AM band) and 88~108 MHz (FM band). In other word, the impedance is matched with 50 Ohm for those frequency bands and suitable for radio application.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

What is claimed is:

1. A fin-shaped antenna apparatus for vehicle radio application, the fin-shaped antenna apparatus electrically connected to a wireless receiver circuit and comprising:

a fin-shaped cover comprising an inner space defined therein;

a metal base assembled with the fin-shaped cover and fixed to a vehicle casing;

an AM antenna arranged in the inner space;

a signal amplifier circuit board arranged on the metal base, wherein an AM signal amplifying circuit, an FM resonance circuit and an FM signal amplifying circuit are arranged on the signal amplifier circuit board, a plurality of inductors form an FM resonance circuit with the FM signal amplifying circuit, wherein a signal reception of the FM resonance circuit is enhanced by the metal base.

2. The fin-shaped antenna apparatus as in claim 1, wherein the AM antenna is arranged on a top inner side of the fin-shaped cover.

3. The fin-shaped antenna apparatus as in claim 1, wherein the AM antenna is an unbalanced circuit.

4. The fin-shaped antenna apparatus as in claim 1, wherein the FM antenna is a balanced circuit.

5. The fin-shaped antenna apparatus as in claim 1, wherein the metal base is electrically connected to the FM antenna for enhancing signal reception for the FM antenna.

6. The fin-shaped antenna apparatus as in claim 1, wherein the signal amplifier circuit board comprises a power regulator powered by a vehicle power and supplying a stable electrical power to the AM signal amplifying circuit and the FM signal amplifying circuit.

7. The fin-shaped antenna apparatus as in claim 1, wherein the AM antenna is a magnetic core with winding thereon.

* * * * *